US008777549B2

(12) United States Patent
Shock et al.

(10) Patent No.: US 8,777,549 B2
(45) Date of Patent: Jul. 15, 2014

(54) DIE ROTATION SYSTEM AND METHOD

(75) Inventors: Dustin M. Shock, Troy, OH (US); Johnrobert J. Teets, Lakeview, OH (US)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 13/532,553

(22) Filed: Jun. 25, 2012

(65) Prior Publication Data

US 2012/0328406 A1 Dec. 27, 2012

Related U.S. Application Data

(60) Provisional application No. 61/500,968, filed on Jun. 24, 2011.

(51) Int. Cl.

| | |
|---|---|
| ***B22C 17/00*** | (2006.01) |
| ***B22C 17/08*** | (2006.01) |
| ***B65H 15/00*** | (2006.01) |
| ***B65H 15/02*** | (2006.01) |

(52) U.S. Cl.

USPC ..... 414/758; 254/95; 414/766; 414/421

(58) Field of Classification Search

USPC ..... 100/188 R; 192/139, 140, 215; 198/403; 408/71; 414/405, 413, 419, 420, 421, 414/422, 425, 620, 621, 743, 758, 763, 764, 414/766, 767, 769, 770, 773, 778, 779, 783, 414/789.2; 72/427; 70/10.2, 10.39

See application file for complete search history.

(56) References Cited

U.S. PATENT DOCUMENTS

| | | | | | |
|---|---|---|---|---|---|
| 3,012,447 | A | * | 12/1961 | Wallace | 74/526 |
| 3,303,558 | A | * | 2/1967 | Horlacher et al. | 29/239 |
| 3,986,617 | A | * | 10/1976 | Blomquist | 409/221 |
| 4,078,461 | A | | 3/1978 | Ohta | |
| 4,094,055 | A | | 6/1978 | Morimoto | |
| 4,253,790 | A | * | 3/1981 | Aberegg et al. | 414/420 |
| 4,449,390 | A | | 5/1984 | Pontini | |
| 4,660,404 | A | * | 4/1987 | Rugh et al. | 72/446 |
| 4,660,406 | A | * | 4/1987 | Rugh et al. | 72/448 |
| 4,665,785 | A | | 5/1987 | Thurner | |

(Continued)

FOREIGN PATENT DOCUMENTS

| | | | |
|---|---|---|---|
| EP | 1410860 | A1 | 4/2004 |
| JP | 2004-74266 | A | 3/2004 |
| KR | 10-2010-0000225 | A | 1/2010 |

*Primary Examiner* — Gregory Adams
(74) *Attorney, Agent, or Firm* — Standley Law Group LLP

(57) ABSTRACT

A system and method for partially or completely inverting (rotating) a die and subsequently returning the die to its normal operating position. Systems of the invention include a roll-over unit that engages a roll frame or similar structure to which a die of interest is temporarily secured. The roll-over unit includes a drive motor that is used to rotate the roll frame and the die that is releasably coupled thereto. A deceleration assembly is provided to bring rotation of the die to a slow and controlled stop in one or both rotational directions. When the drive motor is a hydraulic motor, the deceleration assembly may include deceleration valves that are actuated by a rack gear that is caused to move linearly during rotation of the drive motor.

17 Claims, 5 Drawing Sheets

(56) References Cited

U.S. PATENT DOCUMENTS

| | | | | |
|---|---|---|---|---|
| 4,993,933 | A * | 2/1991 | Yoshioka et al. | 425/190 |
| 5,927,932 | A * | 7/1999 | Seaberg | 414/620 |
| 6,209,431 | B1 | 4/2001 | Wickham | |
| 6,238,164 | B1 * | 5/2001 | Isaacs | 414/405 |
| 6,918,280 | B2 * | 7/2005 | Poppe | 72/426 |
| 7,048,268 | B2 * | 5/2006 | Arai et al. | 269/296 |
| 2006/0018748 | A1 * | 1/2006 | Tran | 414/758 |
| 2009/0237026 | A1 * | 9/2009 | Panaitescu et al. | 318/630 |

* cited by examiner

DIE ROTATION SYSTEM AND METHOD

CROSS-REFERENCE TO RELATED APPLICATIONS

This application claims the benefit of U.S. Provisional Application No. 61/500,968, which was filed on Jun. 24, 2011 and is incorporated by reference herein.

TECHNICAL FIELD

The present invention is directed to a device for rotating a die, such as but not limited to, a trim die.

BACKGROUND

It is well known that dies of various design are used in a number of different stamping, forming, and/or trimming processes. These processes may involve, without limitation, the creation and/or alteration of sheet metal parts or cast parts.

It would be understood by one of skill in the art that there may be various occasions within such a process wherein an associated die needs to be at least partially rotated (i.e., rolled-over to an inverted or partially inverted orientation). One such example involves a trimming die used in a cast part trimming operation, where gates, runners, flash, etc., are trimmed/removed from a cast part. During such an operation, it is common for the trimmed part to be removed from the die and for the die to subsequently traverse to a position where it is at least partially rotated so that the trimmed gates, runners, flash, etc., are dumped into a pit or other collection receptacle for transfer to a furnace for remelting.

It would also be understood by one of skill in the art that such dies are typically very heavy and, therefore, the transfer and particularly rotation thereof may be difficult to accomplish smoothly. For example, when rotating a die, it is generally difficult to smoothly terminate the inverting rotational motion or the return (reverting) rotational motion of the die due to the inertia and momentum associated therewith. Rather, the use of known systems and methods for accomplishing die rotation typically results in an abrupt and jarring termination of an inverting or reverting operation, typically from the die or a component to which it is coupled impacting a hard stop. This may lead to damage to the die being rotated and/or to the device used to rotate the die.

Therefore, it would be desirable to provide a system and method for rotating a die that avoids the aforementioned jarring movement. Ideally such a system would also be robust, reliable, easy to service and troubleshoot, and inexpensive to maintain. A die rotation system of the present invention is such a system.

SUMMARY

A die rotation system of the present invention is capable of smoothly rotating (i.e., rolling over) a die to an inverted (meaning wholly or partially inverted) position in a controlled manner and without the undesirable jarring or impact effects described above. A system of the present invention may be associated with or completely separate from other devices or systems that are used to transfer the die between various positions, such as trimming, unloading, and inverted positions.

A system of the present invention generally includes a roll-over unit that is coupled to a pivotable die support structure (e.g., roll frame) to which a die is temporarily and releasably secured. Embodiments of the roll-over unit are powered by a motor coupled to a drive mechanism. In one exemplary embodiment, the drive motor is a hydraulic motor, which turns a drive sprocket to which is connected a drive chain. The drive chain is used to rotate an inversion sprocket that is coupled, such as by a shaft, to the roll frame. Consequently, operation of the drive motor causes a corresponding rotation of the inversion sprocket and a rotation (flipping) of the roll frame and associated die.

The degree of die rotation may be controlled by use of a limit switch, proximity switch, or some other sensor adapted to detect die rotation and cause a reversal thereof once the die reaches some predetermined inversion point. For example, upon reaching a desired inversion point, a limit switch may be tripped, which causes a reversal in the direction of drive motor rotation (e.g., by reversing the direction of flow of hydraulic fluid) and a corresponding return (reversion) of the die to its upright position.

Embodiments of the present invention also include a deceleration assembly that acts to smoothly terminate the inversion and reversion rotational motion of the die. That is, the deceleration assembly functions to smoothly decelerate and halt die inversion/reversion so that the aforementioned jarring and impact effects of known systems are avoided.

To this end, embodiments of the present invention may be equipped with deceleration valves that, when actuated, meter (restrict) the flow of hydraulic fluid to slow the rotational movement of the die and reduce or eliminate impact forces associated with the end point of die inversion/reversion.

In one embodiment, a pair of deceleration valves may be located near the inversion sprocket. The deceleration valves may be equipped with plungers or similar actuators. A rack gear may be positioned near the deceleration valves such that movement of the rack gear by some amount in one direction will actuate one of the deceleration valves. Movement of the rack gear in an opposite direction will have the same effect on the other deceleration valve. The rack gear may be linearly driven by rotation of a corresponding pinion coupled to the inversion sprocket. The deceleration assembly may also be associated with position sensors (e.g., limit switches, proximity switches) and appropriate actuating elements that interact to reverse movement of the die. Alternatively, these position sensors may be located elsewhere.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1C:
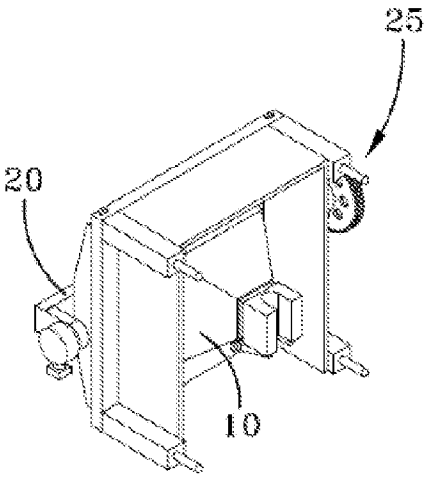
FIGS. 1A-1C depict a lower half of an exemplary trim die as it moves from a post-trimming position within a trim press, to a roll-over engagement position, and then to an inverted position, in accordance with the use of an exemplary die rotation system and method of the present invention.
Figure 1B:
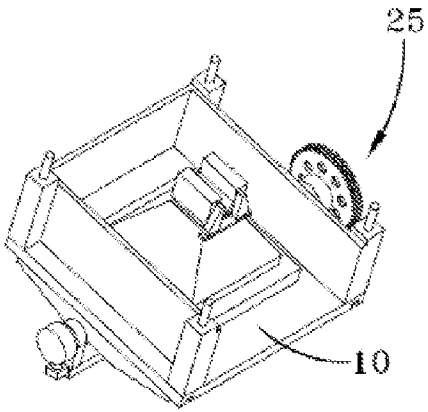
Figure 1A:
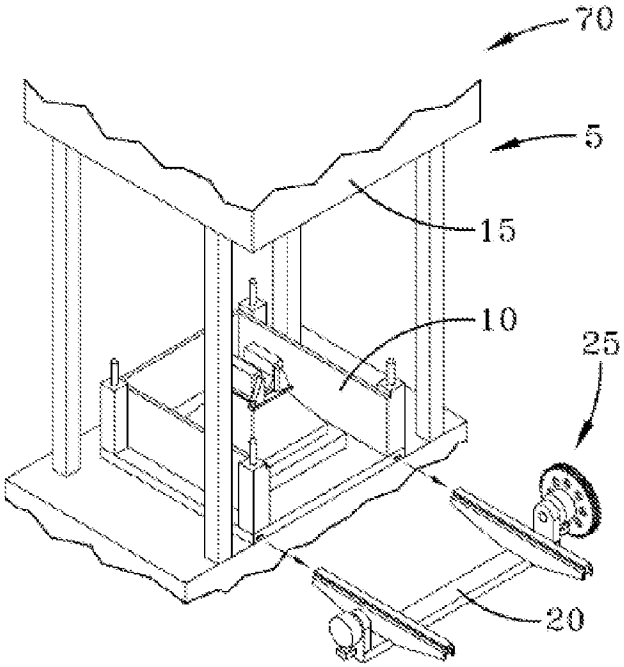

As stated above, a system and method of the present invention may be used to rotate a variety of die types. As an example, a trim die 5 for removing gates, runners, flash, etc., from a cast part is shown in FIGS. 1A-1C. As shown in FIG. 1A, the trim die 5 has completed the trimming operation and the die has been opened such that the lower and upper die halves 10, 15 thereof are separated. Only the lower die half 10 is actually moved between a trimming position and a rotated position according to the present invention. As shown in FIG. 1A, the lower die half 10 still resides within a trim press 70.

As shown in FIGS. 1B-1C, the lower die half 10 is transferred from within the trim press 70 toward a dumping position, where it will be rotated to dislodge trimmed materials into a receptacle 180. Transfer of the lower die half 10 to the dumping position may occur by any number of drive systems known in the art and used for such purposes and, therefore, such drive systems need not be further described herein.

When the lower die half 10 reaches the position shown in FIG. 1B, it is engaged by a die rotation system of the present invention for the purpose of inverting or semi-inverting the lower die half 10 and causing accumulated scrap to be dumped, as mentioned above. As can be observed in FIGS. 2-5, the die rotation system may include at least a roll frame 20, a roll-over unit 25, and a deceleration system 100.

Figure 2:
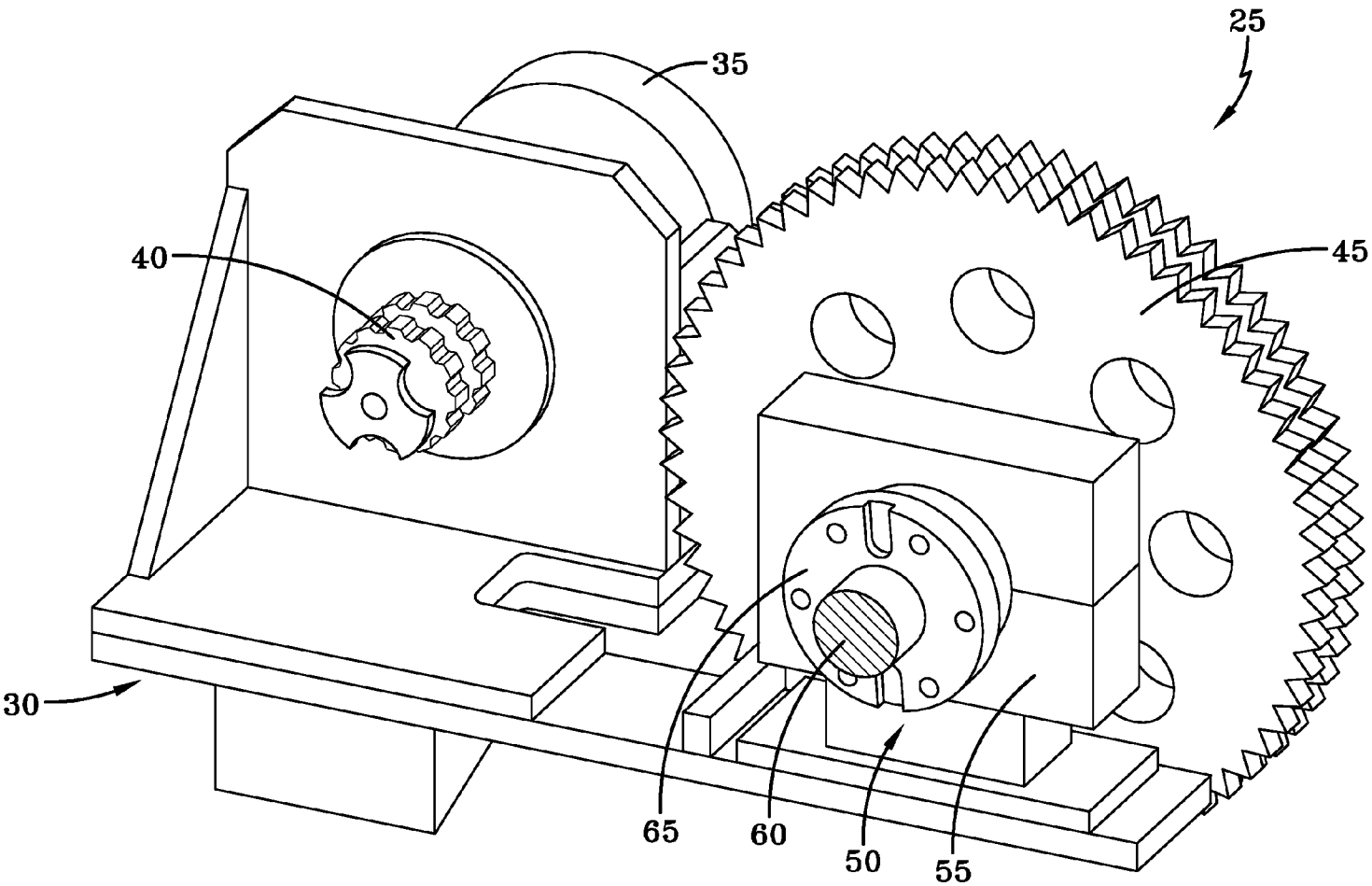
FIG. 2 is a perspective view of a front side of one exemplary embodiment of a roll-over unit of the present invention.
Figure 3:
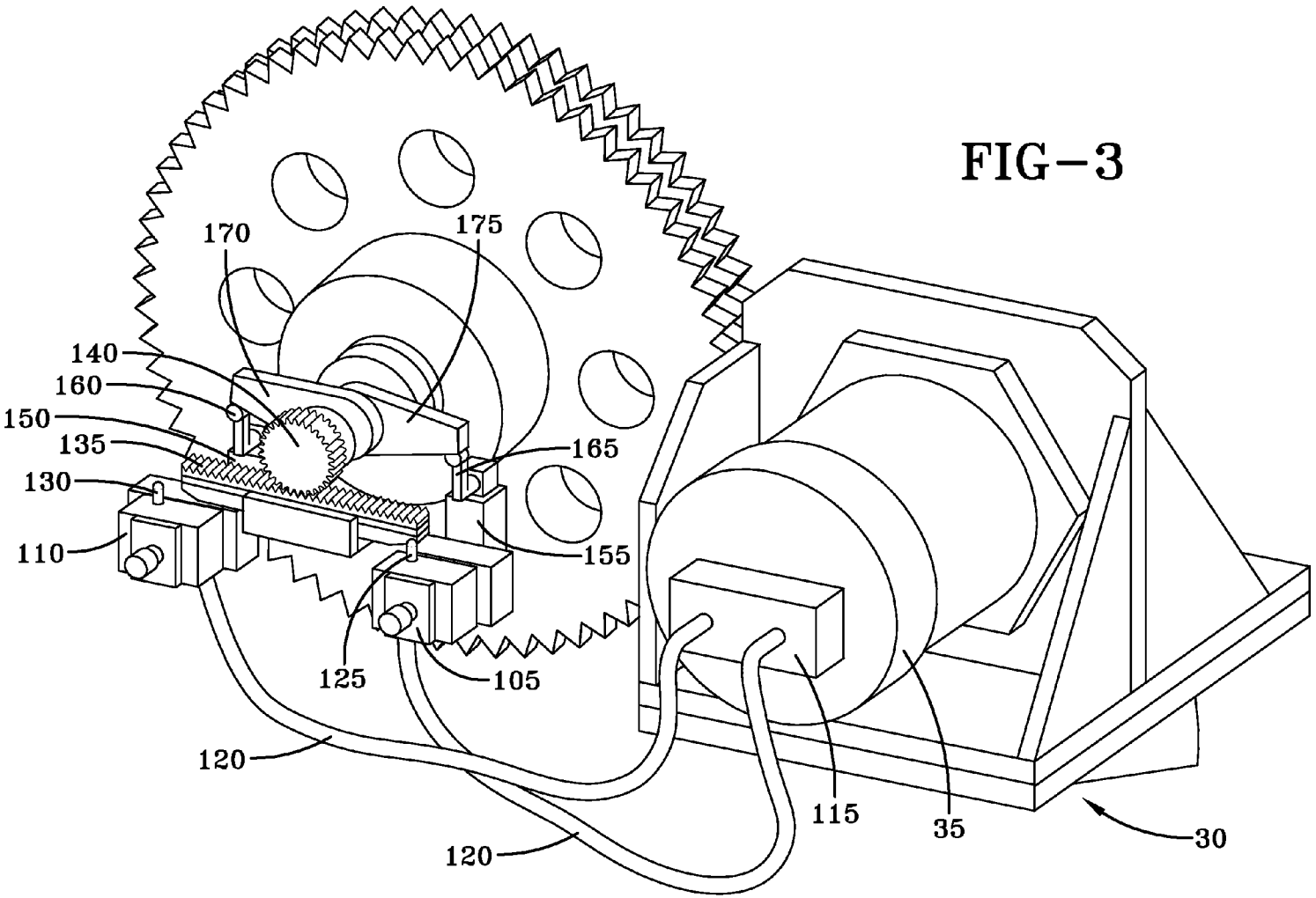
FIG. 3 is a perspective view of a rear side of the roll-over unit of FIG. 2.

An exemplary roll-over unit 25 is illustrated in more detail in FIGS. 2-3. As shown, the roll-over unit 25 includes a frame 30 to which the various components of the roll-over unit 25 may be attached. The roll-over unit 25 also includes a drive motor 35 which, in this case, is a bi-directional (i.e., reversible) hydraulic drive motor. The drive motor 35 is coupled to a drive gear 40 that extends toward the roll frame 20 (see FIG. 4) and is used to engage and rotate the die half 10. The roll-over unit 25 also includes an inversion gear 45 that is designed for coupling to the drive gear 40. In this particular example, the drive gear 40 and inversion gear 45 are designed to be coupled by a drive chain 185, but the use of other coupling arrangements (e.g., belts) is also possible. In any event, it can be understood that operation of the drive motor 35 will produce a direct rotation of the drive gear 40 which, in turn, will produce a rotation of the inversion gear 45.

As shown in FIG. 2, a roll-frame engagement and rotation element 50 is coupled to the inversion gear 45 and extends in the same direction as the drive gear 40. Preferably, a shaft portion of the roll-frame engagement and rotation element 50 passes through a bearing 55 for support and rotation facilitation. This particular roll-frame engagement and rotation element 50 includes an extending shaft 60 surrounded by a collar 65, which is provided to connect the output shaft of the inversion gear 45 to the roll frame 20. Obviously, a number of other known mechanisms may be used to couple the inversion gear 45 to the roll frame 20, and all such mechanisms are considered to be within the scope of the present invention.

Figure 4:
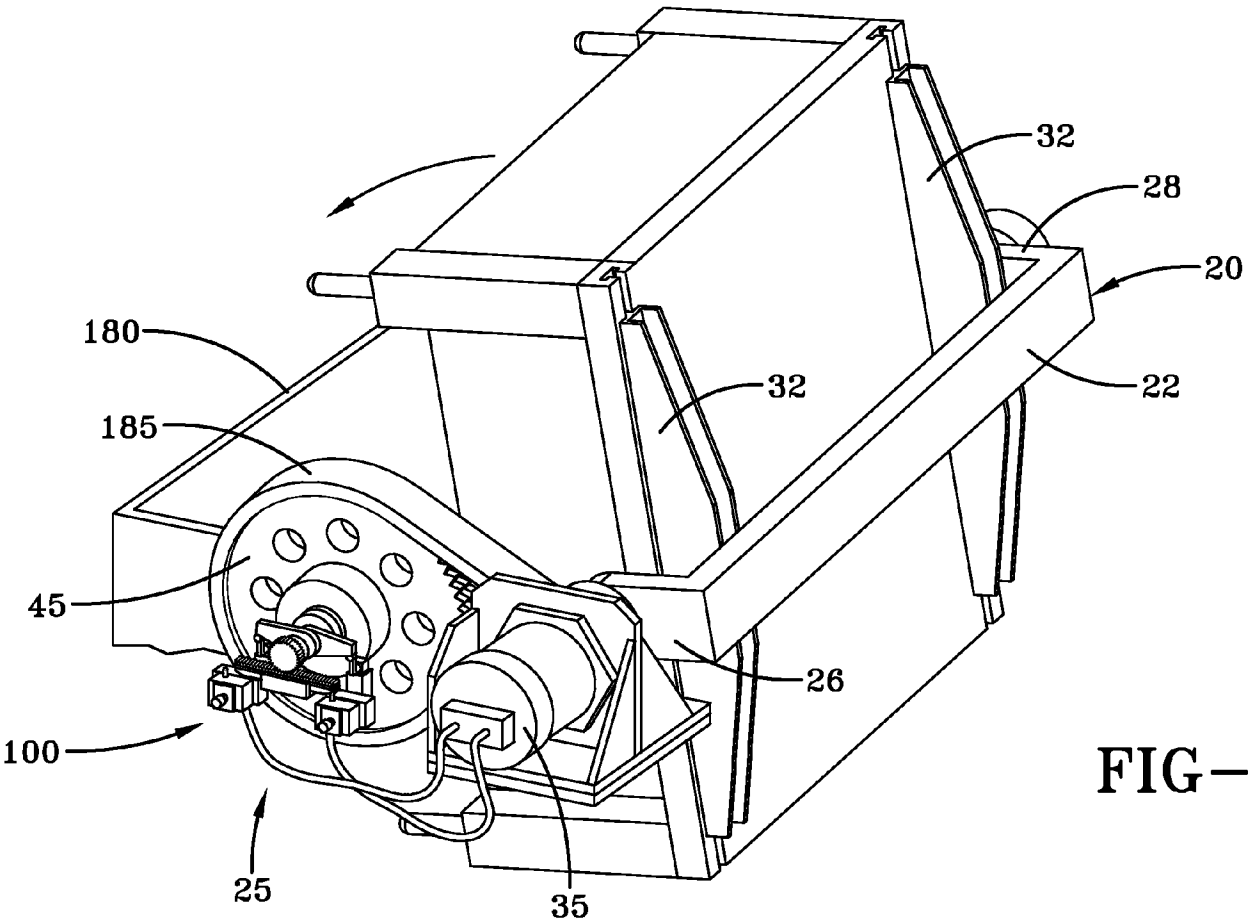
FIG. 4 shows the roll-over unit of FIGS. 2-3 being used in conjunction with a coupled roll frame to rotate the lower die half of FIGS. 1A-1C.

The relationship of the roll-over unit 25 to the roll frame 20, and use thereof to rotate the lower die half 10 is most clearly depicted in FIG. 4. As shown therein, the roll frame 20 is basically a welded or otherwise securely assembled framework designed to receive and support the lower die half 10 once it traverses to the rotation position of FIG. 1C. In this particular example, the roll frame 20 includes a generally U-shaped connecting portion 22 having a transverse leg 24 that transversely spans the travel path of the lower die half 10 and a pair of vertical legs, 26, 28 that extend from opposite ends of the transverse leg 22 and are respectively connected between the roll-frame engagement and rotation element 50 of the roll-over unit 25 and a bearing or other rotation facilitating element located across from the roll-over unit 25. This particular roll-over unit 25 also includes die support arms 32 that are attached to and extend from the transverse leg 24 for supporting the lower die half 10. The roll frame 20 may reside and rotate at least partially within a pit or other recess located along the travel path of the lower die half 10 so that the roll frame 20 is located at a proper height to receive the lower die half 10.

During a rotation operation, the lower die half 10 may be temporarily secured to the roll frame 20 in various ways. In this particular example, the lower die half 10 is equipped with guide blocks (not shown) that ride on and capture substantially T-shaped guide rails (not visible in FIG. 4). The lower die half rides on these guide rails as it traverses from the trim press 15 to the rotation position. Sections of such T-shaped guide rail are attached to an upper surface of each die support arm 32, such that the lower die half 10 is able to smoothly transition onto the roll frame 20. Further, because the guide rails are securely attached to the support arms 32 and also trapped within the guide blocks, the lower die half 10 remains secured to the rails and to the roll frame 20 during die rotation. A hard stop or similar element may be located at a forward end of the guide rails to prevent a sliding movement of the lower die half 10 during die rotation. In other embodiments, clamps or other securing mechanisms may be used to secure a die half to a roll frame in lieu of or in addition to the guide block/guide rail assembly described above.

Figure 5:
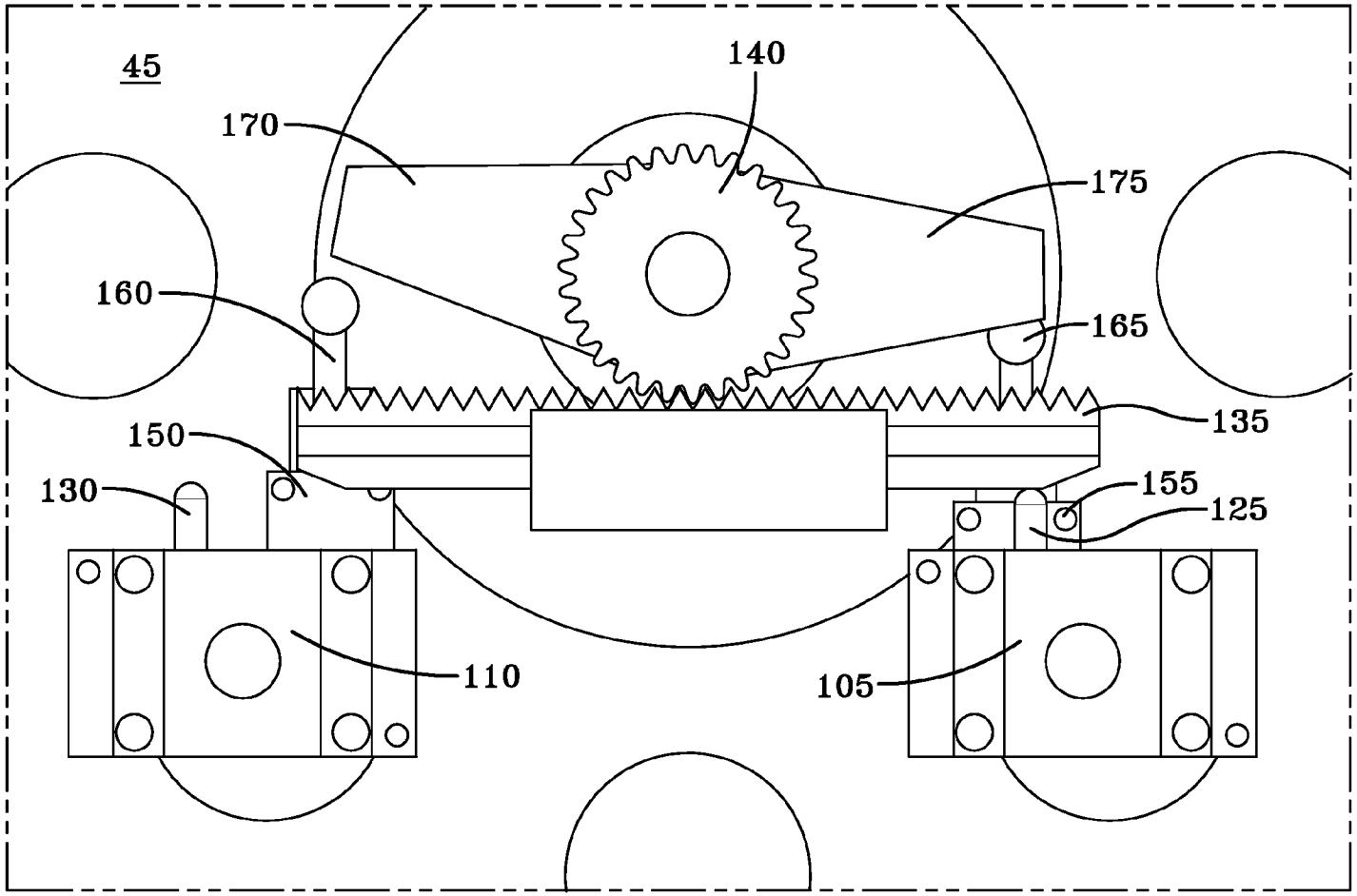
FIG. 5 is an enlarged view of a deceleration assembly viewable in FIGS. 3 and 4.

Referring now to FIG. 5, it can be observed that the roll-over unit 25 also includes a deceleration assembly 100. The deceleration assembly 100 includes a pair of deceleration valves 105, 110 that are placed in fluid communication with a fluid supply block 115 (or directly with the inlet/outlet ports) of the hydraulic motor 35 by appropriate fluid conduit 120. Each deceleration valve 105, 110 includes an actuator, in this case a plunger 125, 130, for activating the corresponding deceleration valve.

As part of the deceleration assembly 100, a rack gear 135 is mounted to a frame or similar element (not shown) located rearward of the inversion gear 45. An associated pinion (e.g., spur gear) 140 is coupled to a rear of the inversion gear 45 or to a shaft portion thereof and positioned to be engaged with the rack gear 135.

In operation, hydraulic fluid supplied to the drive motor 35 from a pressurized source (not shown) either passes through the deceleration valves 105, 110 or can be otherwise metered by the deceleration valves 105, 110. With the roll frame 20 engaged with the roll-frame engagement and rotation element 50 of the roll-over unit 25, pressurized hydraulic fluid is supplied to the drive motor 35, causing the powered rotation thereof. This produces a corresponding rotation of the drive gear 40 and the inversion gear 45, which causes a rotation of the roll frame 20 and lower die half 10 secured thereto (see FIG. 10 and FIG. 4).

As the inversion gear 45 rotates, the pinion 140 also rotates, thereby causing a linear translation of the rack gear 135 toward one deceleration valve 105 or the other 110 (depending on the direction of rotation of the inversion gear 45). For example, referring to FIGS. 3-5, it can be understood that as the inversion gear 45 is rotated counterclockwise to invert the lower die half 10 in this particular example, the pinion 140 will cause the rack gear 135 to move linearly toward the inversion deceleration valve 105. When the lower die half 10 reaches some selected point prior to a predetermined degree of rotation, the rack gear 135 will contact and depress the plunger 125 of the inversion deceleration valve 105, which causes the inversion deceleration valve to meter (restrict) the flow of hydraulic fluid to the drive motor 35. This reduces the speed of die rotation and allows the die to reach an inverted stop point in a slow and controlled manner (without causing an adverse impact or jarring effect).

The same slow and controlled stopping of rotational die movement occurs when the die is thereafter rotated (reverted) to its normal upright position. That is, as the inversion gear 45 is rotated clockwise to revert the lower die half 10 in this particular example, the pinion 140 causes the rack gear 135 to move linearly toward the reversion deceleration valve 110. When the lower die half 10 reaches some selected point prior to its normal operating position, the rack gear 135 will contact and depress the plunger 130 of the reversion deceleration valve 110 (see FIG. 4), which causes the reversion deceleration valve 110 to meter (restrict) the flow of hydraulic fluid to the drive motor 35, thereby reducing the speed of die rotation and allowing the die to reach a normal operating stop point in a slow and controlled manner (without causing an adverse impact or jarring effect).

As should be apparent from the drawing figures, the spacing between the deceleration valves 105, 110, the length of the rack gear 135, the pitch of the rack gear 135 and pinion 140, and/or other parameters of the deceleration assembly 100 and/or roll-over unit 25 may be adjusted to ensure that the appropriate deceleration valve 105, 100 is activated by the rack gear 135 at the proper time.

The overall degree of rotation of the roll frame 20 and associated lower die half 10, may be controlled through the use of sensors. In this particular exemplary embodiment, those sensors are in the form of limit switches 150, 155. In other embodiments, the sensors may be proximity switches, photo eyes, etc. The sensors may be located in various places so as to be properly activated.

Referring to FIGS. 3 and 5, it can be observed that in this embodiment, limit switches 150, 155 are mounted near the deceleration assembly 100 and corresponding limit switch trip levers 170, 175 are associated with an output shaft of the inversion gear 45. Consequently, rotation of the inversion gear 45 during die rotation also rotates the trip levers 170, 175 and causes one or the other of the trip levers 170, 175 to contact one or the other of the limit switch actuator arms 160, 165, depending on the direction of rotation of the inversion gear 45. For example, as the inversion gear 45 rotates in a counterclockwise direction during a die inversion operation, the inversion trip lever 175 also rotates counterclockwise until it contacts the inversion limit switch actuator arm 160 and activates the inversion limit switch 150. This causes the inverting rotation of the lower die half 10 to stop and also reverses the drive motor 35, thereby causing the lower die half 10 to be reverted to its normal operating position. When the lower die half 10 reaches its normal operating position, the reversion trip lever 170 contacts the reversion limit switch actuator arm 165 and activates the reversion limit switch 155. A signal from the reversion limit switch 155 may be used, for example, to release an interlock and/or to signal a die traversing mechanism to return the lower die half 10 to the trim press 15.

While certain embodiments of the present invention are described in detail above, the scope of the invention is not to be considered limited by such disclosure, and modifications are possible without departing from the spirit of the invention as evidenced by the following claims:

What is claimed is:

1. A die rotation system for rotating a die between an upright position and an inverted position, comprising:

a roll-over unit including at least a hydraulic drive motor and an inversion gear rotatably driven by the drive motor;

a die support frame coupled to the roll-over unit;

a deceleration mechanism for slowing the speed of die rotation prior to a stoppage thereof, the deceleration mechanism comprising a deceleration assembly that includes a pair of deceleration valves and a rack gear residing between the deceleration valves and located to independently actuate the deceleration valves when linearly displaced in one direction or an opposite direction; and a sensor for indicating a rotational position of the die.

2. The die rotation system of claim 1, wherein the pair of deceleration valves are located near the inversion gear, and a pinion is coupled to the inversion gear and engaged with the rack gear so as to linearly move the rack gear during rotation of the inversion gear.

3. The die rotation system of claim 2, wherein the rack gear is adapted to activate a corresponding one of the deceleration valves during inverting and reverting die rotation.

4. The die rotation system of claim 3, wherein the deceleration valves are adapted to restrict a flow of hydraulic fluid to the hydraulic drive motor to slow the speed of die rotation prior to a stoppage thereof.

5. The die rotation system of claim 1, wherein a sensor for indicating a desired degree of die inversion and a sensor for indicating an upright die position are present.

6. The die rotation system of claim 5, wherein the sensors are limit switches located near the inversion gear, and an output shaft of the inversion gear is coupled to trip levers that are positioned to selectively actuate the limit switches during inversion and reversion of a die.

7. The die rotation system of claim 1, further comprising a mechanism for releasably securing a die to be rotated to the die support frame during a rotation operation.

8. The die rotation system of claim 7, wherein the mechanism for releasably securing a die to be rotated to the die support frame includes guide slots in a lower portion of the die to be rotated, the guide slots adapted for engagement with corresponding guide rails attached to an upper surface of the die support frame.

9. The die rotation system of claim 7, wherein the mechanism for releasably securing a die to be rotated to the die support frame is comprised of one or more clamps.

10. A die rotation system for rotating a lower die half of a die between an upright position and an inverted position, comprising:

a roll-over unit including at least a hydraulic drive motor and an inversion gear rotatably driven by the drive motor;

a pivotable roll frame for supporting a die to be rotated, the roll frame rotatably coupled to the roll-over unit;

a mechanism for releasably securing a die to be rotated to the roll frame during a rotation operation;

a deceleration assembly including a pair of deceleration valves located near the inversion gear, a rack gear residing between the deceleration valves and located to independently actuate the deceleration valves when linearly displaced in one direction or an opposite direction, and a pinion coupled to the inversion gear and engaged with the rack gear so as to linearly move the rack gear during rotation of the inversion gear;

at least one sensor for indicating a desired degree of die inversion and for indicating an upright die position;

wherein, the rack gear is adapted to activate a corresponding one of the deceleration valves during inverting and reverting die rotation, and wherein the deceleration valves are adapted to restrict a flow of hydraulic fluid to the drive motor to slow the speed of die rotation prior to a stoppage thereof.

11. The die rotation system of claim 10, wherein the roll-over unit further includes a frame and a drive gear coupled to the drive motor, the drive gear coupled to the inversion gear such that operation of the hydraulic motor produces a rotation of the inversion gear.

12. The die rotation system of claim 10, wherein the roll frame is coupled to a roll-frame engagement and rotation element that is, in turn, coupled to the inversion gear and extends in the same direction as the drive gear.

13. The die rotation system of claim 12, wherein the roll-frame engagement and rotation element includes an extending shaft surrounded by a collar, which is provided to connect the output shaft of the inversion gear to the roll frame.

14. The die rotation system of claim 12, wherein the roll frame includes a connecting portion with a transverse leg that transversely spans a travel path of the lower die half, and a pair of vertical legs that extend from opposite ends of the transverse leg and are respectively connected between the roll-frame engagement and rotation element and a rotation facilitating element located across from the roll-over unit.

15. The die rotation system of claim 10, wherein the roll frame includes die support arms for supporting the lower die half, with guide rails attached to an upper surface of the support arms and corresponding guide slots located in a lower portion of a lower die half to be rotated, the guide slots and guide rails adapted to collectively secure the lower die half to the roll frame during die rotation.

16. The die rotation system of claim 10, wherein the at least one sensor is a pair of limit switches located near the inversion gear, and an output shaft of the inversion gear is coupled to trip levers that are positioned to selectively actuate the limit switches during inversion and reversion of a lower die half.

17. A method of rotating a lower die half of a die between an upright position and an inverted position, comprising:

transferring a die half of interest from a working location onto the roll frame of the die rotation system of claim 10;

using the die rotation system to invert the lower die half;

using the die rotation system to revert the lower die half; and returning the lower die half to the working location.

* * * * *